United States Patent [19]

Sherman

[11] 4,239,470

[45] Dec. 16, 1980

[54] THICK STOCK PUMP HAVING FLEXIBLE BLADES

[75] Inventor: Michael I. Sherman, Glens Falls, N.Y.

[73] Assignee: Kamyr, Inc., Glens Falls, N.Y.

[21] Appl. No.: 14,363

[22] Filed: Feb. 23, 1979

Related U.S. Application Data

[63] Continuation-in-part of Ser. No. 940,741, Sep. 8, 1978, abandoned.

[51] Int. Cl.[3] ..... F04C 18/02

[52] U.S. Cl. ..... 418/153; 162/246; 415/141; 418/206

[58] Field of Search ..... 418/206, 153, 1, 46, 418/156, 154; 415/65, 141; 416/240; 68/5 C, 181 R; 162/237, 242, 246, 65, 57; 417/284

[56] References Cited

U.S. PATENT DOCUMENTS

| | | | |
|---|---|---|---|
| 2,403,796 | 7/1946 | Hanna | 418/206 |
| 2,460,278 | 2/1949 | Cook | 418/46 X |
| 2,530,767 | 11/1950 | Hamill | 418/153 |
| 2,719,001 | 9/1955 | Knuth | 418/206 X |
| 2,753,809 | 7/1956 | Garrison | 418/153 |
| 2,857,848 | 10/1958 | McLean | 418/154 |
| 3,054,355 | 9/1962 | Neely | 418/154 |
| 3,594,106 | 7/1971 | Garrison | 418/202 |
| 3,976,408 | 8/1976 | Garrison | 418/153 |

FOREIGN PATENT DOCUMENTS

| | | | |
|---|---|---|---|
| 901266 | 7/1962 | United Kingdom | 418/154 |

OTHER PUBLICATIONS

Sandy Hill Corporation; "High Density Pump" brochure.

*Primary Examiner*—S. Leon Bashore
*Assistant Examiner*—Steve Alvo
*Attorney, Agent, or Firm*—Cushman, Darby & Cushman

[57] ABSTRACT

A pump for pumping high consistency materials such as paper pulp having a consistency of about 8% or more. The pump includes a pair of rotors disposed in a pumping chamber, and a number of blades extending radially from each rotor, each blade mounted for cooperation with a circumferential portion of the other rotor in sequence during rotation of the rotors in operation. The blades are suitably constructed so that during normal pumping of high consistency material they can produce a head of about 10–170 ft., remaining rigid during normal pumping. However, the blades will flex out of engagement with tramp metal or the like when encountered thereby so that no damage to the pump components results during normal operation. A relatively large clearance can be provided between each blade and its cooperating circumferential portion of the opposite rotor. The pump is especially utilizable in pulp treatment systems between vessels adapted to have high density cellulosic pulp therebetween.

1 Claim, 11 Drawing Figures

THICK STOCK PUMP HAVING FLEXIBLE BLADES

CROSS-REFERENCE TO RELATED APPLICATION

This application is a continuation-in-part of my application Ser. No. 940,741, filed Sept. 8, 1978, now abandoned.

BACKGROUND AND SUMMARY OF THE INVENTION

The invention relates to a high density stock pump, and method of operation thereof, especially for use with equipment in pulp mills. In the past, for low consistency pulp (about 5% or less) ordinary stock pumps were used to transport the pulp from stage to stage, and where high consistency pulp (about 8% or greater) was present gravity feeds were normally used to effect transport of the pulp. However, with the recent advent of medium and high consistency components for all phases of pulp treatment, thick stock pumps have become desirable since they allow flexability in planning of a mill, and efficient utilization of equipment. A number of conventional thick stock pumps are on the market for pumping high consistency material, and such pumps in general perform their intended functions very effectively. However, in some installations and with some sources of supply, a large amount of tramp metal is intermixed with a high consistency material. The tramp metal can quickly result in damage to the thick stock pump rotors and blades. This problem can be minimized, all though not entirely eliminated, by utilizing chip cleaning systems; however such chip cleaning systems are expensive to install and operate. Additionally, prior art systems are not successful for solving the tramp metal problem to the extent that thick stock pumps can be placed directly in the digester discharge line, but by utilizing a pump according to the present invention it is possible to place a thick stock pump directly in the digester discharge line.

According to the present invention, the tramp metal problem in conventional pulp mills is handled in a simple and effective manner by making relatively simple modifications to conventional thick stock pumps. According to the present invention, a pump is provided for pumping high consistency material comprising means for defining a closed pumping chamber including an inlet and an outlet; a pair of rotors; means for transforming rotation of the rotors into linear pumping of the high consistency materials so that a head of about 10 to 170 ft. can be achieved during pumping and so that damage will not occur to the pump when tramp metal or the like is contained within the high consistency material pump, said means comprising a plurality of blades associated with each rotor and extending radially therefrom which remain rigid during pumping of high consistency material but flex so as to prevent damage to any pump components when tramp metal or the like is encountered thereby; means for rotating the rotors in opposite angular directions, said means including a shaft associated with each rotor; and means for mounting the rotors so that each blade from one rotor sequentially cooperates with but does not substantially engage a circumferential surface of the other rotor intermediate to blades of the other rotor, during continued rotation of the rotors, and so that each blade sequentially cooperates with but does not substantially engage an interior portion of said closed pumping chamber during continued rotation of said rotor.

Each of the pump blades include a slanted tip having a first end portion thereof located a greater radial distance from the shaft of the rotor with which it is associated than the second end portion thereof, and during rotation of the rotors the first tip end portion of each blade is the leading tip portion of that blade. The necessary flexibility while still achieving high consistency material pumping can be obtained constructing the blades in a number of different manners. In one embodiment according to the invention, each blade consists essentially of an elongated substantially integral member of flexible material. In another embodiment, each blade comprises an elongated substantially integral member of flexible material with a backing member of rigid material extending a smaller radial distance from the rotor circumferential surface then the flexible member. According to another embodiment, each blade comprises a tip portion of relatively rigid material and a base portion of relatively rigid material with an intermediate portion that is flexible. Additionally, instead of employing an inherently flexible material such as rubber or TEFLON for the blades, a set of thin blades or laminates of a springy flexible metal can be provided, either forming the entire blade or inner connecting rigid portions of the blade. Under circumstances where the tramp metal problem is especially severe, relatively large clearances can be provided between each blade from one rotor in the circumferential surface of the other rotor with which it cooperates, and the interior portion of the closed pumping chamber, so that tramp metal may pass between each blade and its cooperating other rotor circumferential surface, and the blade and the interior chamber portion.

The pump according to the present invention is especially useful in lines interconnecting vessels adapted to contain high density cellulosic pulp (at a consistency of greater than about 8%). According to a general combination of the invention, a first vessel containing high density pulp and having an outlet is connected by a connecting line to a second vessel for receiving high density cellulosic pulp, with the pump disposed in the connecting line for pumping the high density material from the first vessel outlet to and thru the second vessel. The first vessel preferably comprises an oxygen reactor (a pressure release mechanism being provided in the interconnecting line), and the second vessel is a diffusion washer. Other advantageous combinations include both the first and second vessels being diffusers, or the first vessel being a high density storage tank and the second vessel being a suitable further component.

By utilizing the pump according to the present invention, a method of pumping high density material having a consistency of greater than about 10% with a head of about 10–170 ft. maybe practiced without damage to the pumping mechanism.

It is the primary object of the present invention to provide a thick stock pump that will not be damaged by tramp metal in the high consistency material being pumped. This and other objects of the invention will become clearer from an inspection of the detailed description of the invention, and from the appended claims.

DETAILED DESCRIPTION OF THE DRAWINGS

Figure 1:
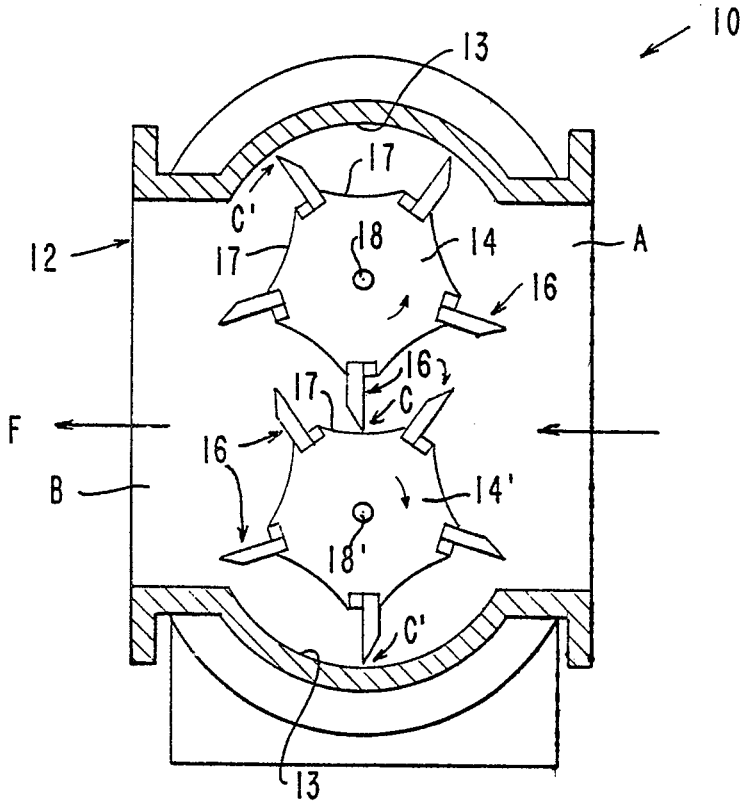
FIG. 1 is a side view partly in section and partly in elevation of an exemplary pump according to the invention.
Figure 2:
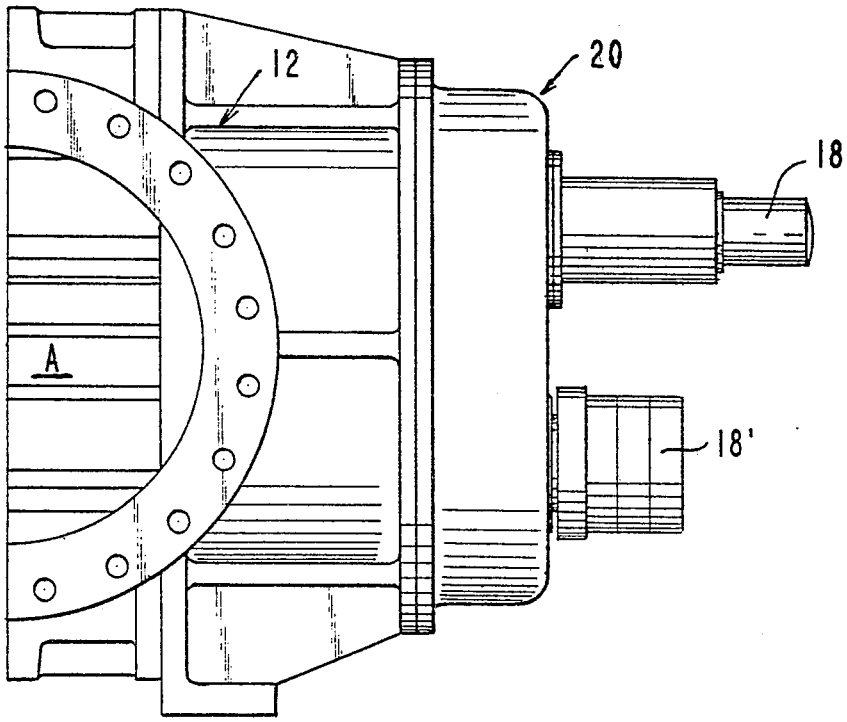
FIG. 2 is a partial end view of the pump in FIG. 1 looking in at inlet A.

An exemplary thick stock pump according to the invention is illustrated generally at 10 in the drawings. The pump 10 includes means 12 for defining a closed pumping chamber (including an inlet A and outlet B), such as a conventional pump housing, and a pair of rotors 14, 14'. Means are provided for transforming rotation of the rotors 14, 14' into linear pumping of high consistency material flowing in direction F (see FIG. 1) so that a head of about 10 to 170 ft. can be achieved during pumping of the high consistency material, and so that damage will not occur to the pump 10 when tramp metal or the like is contained within the high consistency material pumped. Such means include a plurality of blades 16 associated with each rotor 14, 14' and extending radially therefrom, which blades 16 remain rigid during pumping of high consistency material but flex so as to prevent damage to any pump components when tramp metal or the like is encountered thereby. Additionally, according to the invention means are provided for rotating the rotors in opposite angular direction, said means including a shaft 18, 18' (see FIG. 2) associated with each rotor 14, 14'. The shafts 18, 18' will of course be connected up to a suitable power source. Additionally means are provided, such as housing 20 and cooperating bushings, for mounting the rotor shaft 18, 18' so that blade 16 from one rotor 14, 14' sequentially cooperates with but does not substantially engage a circumferential surface 17 of the other rotor 14, 14' intermediate blades 16 of that other rotor 14, 14' during continued rotation of the rotors 14, 14', and so that each blade 16 sequentially cooperates with but does not substantially engage an interior portion 13 of the means 12 defining the closed pumping chamber. As shown in FIG. 1, a clearance C is provided between a blade 16 of one rotor, and a cooperating circumferential surface 17 of the other rotor, and a clearance C' is provided between each blade 16 and the interior portion 13 of the means 12 defining a pumping chamber.

FIGS. 3*a* through 3*d* and FIG. 4 show alternative embodiments that the blades 16 according to the present invention may assume. In each case, preferably each blade 16 includes a slanted tip portion 22 having a first end portion 23 thereof located at a greater radial distance from the shaft 18 (18') of the rotor 14 (14') with which it is associated and a second end portion 24 thereof, the blades 16 being mounted on their respective rotors so that during rotation of the rotors 14, 14' the first tip end portion 23 of each blade is the leading tip portion of that blade, and the second tip portion 24 is the trailing tip portion thereof.

Figure 3A:
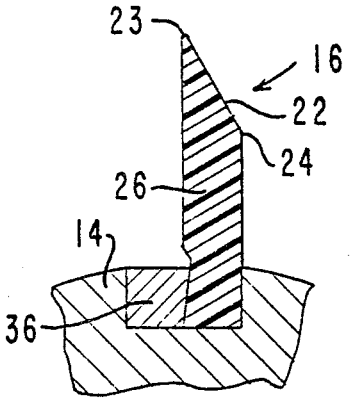
FIG. 3*a* thru 3*d* are cross sectional views of alternative embodiments for blades utilizable in the pump of FIG. 1.
Figure 3B:
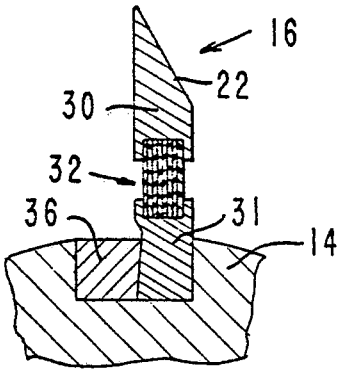
Figure 3C:
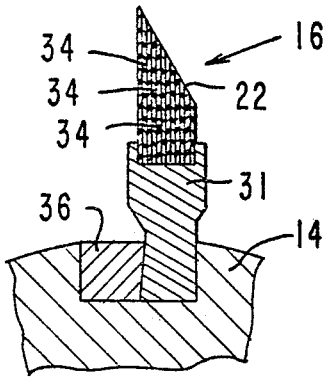
Figure 3D:
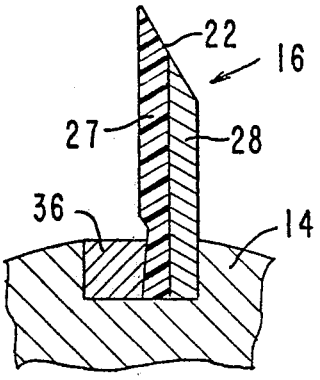
Figure 4:
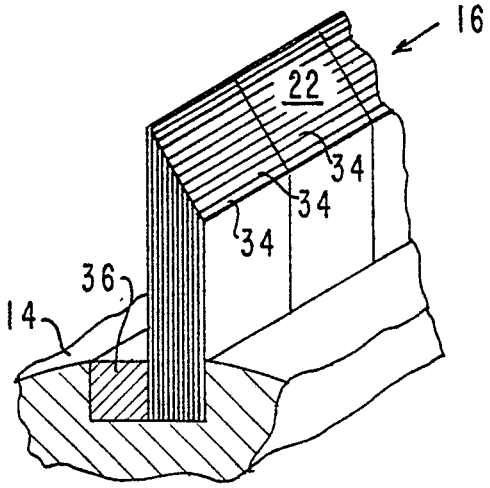
FIG. 4 is a partial perspective view of another alternative embodiment of a blade utilizable with the pump of FIG. 1.

For the embodiment shown in FIG. 3*a*, each blade 16 consists essentially of an elongated substantially integral member of flexible material 26, suitable materials including, but not limited to, rubber and TEFLON. In the embodiment of FIG. 3*d*, the blade 16 comprises an elongated substantially integral member of flexible material 27 and a backing member 28 of rigid material extending a smaller radial distance from the rotor circumferential surface than the flexible member 27, the members 27, 28 being joined together. In the FIG. 3*b* embodiment, the blade 16 comprises a tip portion 30 of relatively rigid material and a base portion 31 of relatively rigid material with an intermediate portion 32 that is flexible. In FIG. 3*c*, only the slanted tip portion 22 is flexible, the base 31' being rigid as shown most clearly in FIG. 4, but also as suggested in FIG. 3*b* and 3*c*, the blade 16 flexible components may be formed of a set of thin blades, or laminates, 34, each of a springy flexible metal. In FIG. 4, the laminates 34 comprise the entire blade 16. For each of the blades shown in FIGS. 3*a* through 3*d* and FIG. 4, preferably a suitable mounting component 36 is provided, and such component 36 can be removable so that the blade 16 may be replaced should they wear excessively. If existing thick stock pumps have removable mounting components for their blades, such blades can be removed and the blades according to the invention substituted therefor assuming that the rotors are otherwise compatible, and the blades are of proper radial extent.

In circumstances where a severe tramp metal problem exists, it may be desirable to mount the shafts 18, 18' in means 20 and adjust or dimension the blades 16 appropriately so that a relatively large clearance C' is provided between each blade 16 from one rotor and an interior surface 13 of the housing means 12 with which it cooperates, so that tramp metal may be passed between each blade 16 and its cooperating interior housing surface 12. The mechanism for powering the shafts 18, 18' should of course have suitable power to make up for the relatively inefficient pumping action that will occur under these circumstances. Under suitable circumstances, the blade 16 could be made rigid assuming that the clearances C' were sufficient and the necessary pumping requirements could be met despite leakage at the clearances C'.

Figure 5A:
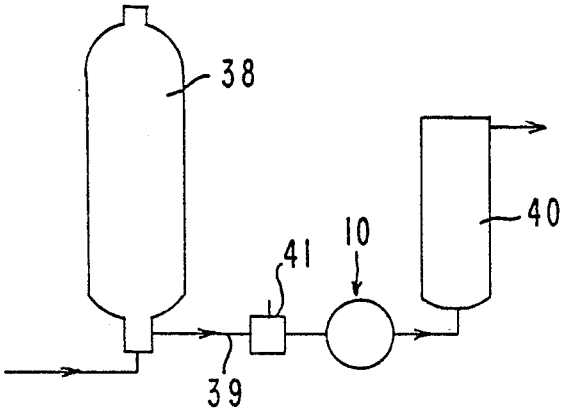
FIG. 5*a* thru 5*d* are exemplary alternatives combinations of pump mill equipment with which the pump of FIG. 1 is especially suitably utilizable.
Figure 5B:
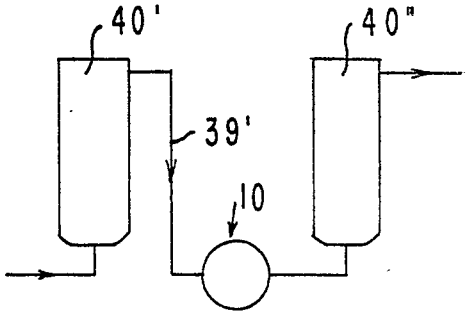
Figure 5C:
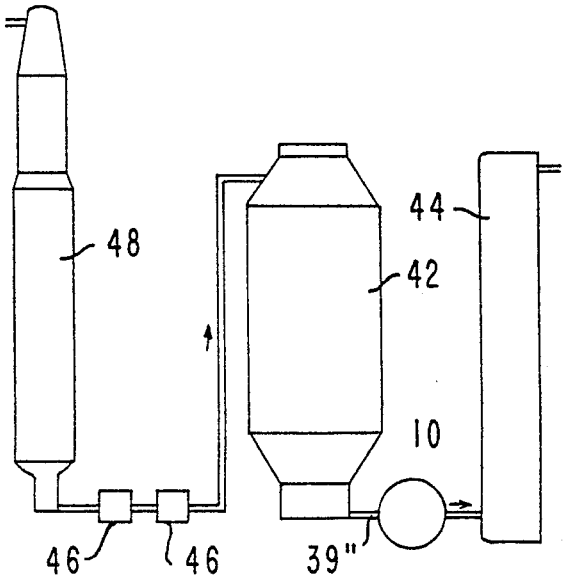
Figure 5D:
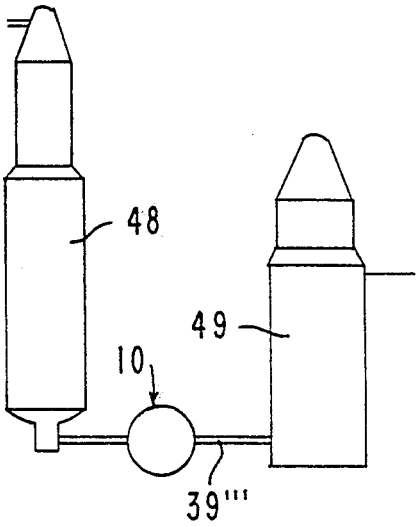

FIGS. 5*a*–5*d* show exemplary combinations of equipment in pulp mill with which the pump, according to the present invention, is advantageously utilizable. The combination according to FIG. 5*a* includes a conventional medium consistency oxygen reactor 38 comprising a first vessel containing high density cellulosic pulp at a consistency of greater than about 8%, and interconnected by a connecting line 39 with a conventional diffusion washer 40, which comprises a second vessel. The pump 10 according to the present invention is disposed in the line 39, and preferably a pressure relief mechanism 41 is also provided in the line 39. In the embodiment of FIG. 5*b*, the first vessel comprises a first conventional diffuser 40' interconnected by line 39' with a second diffuser 40'', the pump 10 being disposed in line 39. In FIG. 5*c*, the first vessel comprises a conventional high density storage tank 42, connected with a line 39'' to any suitable conventional second vessel 44 (such as a conventional bleaching tower), with a pump 10 disposed in the line 39''. A pair of in-line refiners 46 may be disposed between a conventional continuous pulp digester 48 and the high density storage tank 42. FIG. 5*d* illustrates a pump 10 according to the present invention disposed directly in a discharge line 39''' of a conventional continuous digester 48, the line 39''' connecting the digester 48 to a suitable conventional further treatment vessel 49. According to the invention it is possible for the first time to successfully deal with the tramp metal problem while being able to place a thick stock pump directly in a digester discharge line.

An exemplary method of operation of the pump 10 according to the present invention is as follows:

High density material having a consistency of greater than about 8% enters inlet A of the pump 10, flowing in direction F. The high density material is engaged by each blade 16 of each rotor 14, 14' of the pump 10 with sufficient total force effect to produce a head of about 10–170 ft., while the rotors 14, 14' are rotating in different angular directions. The blades 16 remain rigid during normal pumping, but flex out of engagement with tramp metal or the like engaged thereby so that no damage to the pump 10 results during normal operation. With the blade constructed as illustrated in FIG. 3*a*, the entire blade flexes when tramp metal is engaged. With the blade according to the FIG. 3*b*, the intermediate component 32 flexes to allow rigid top portion 30 to move out of the way of tramp metal. In the FIGS. 3*c* and 3*d* constructions, just the tip portion of the blades 16 flex, in FIG. 3*c* the entire tip portion 22, and in FIG. 3*d* just the tip portion associated with flexible number 27. In the FIG. 4 construction, again essentially the entire blade 16 flexes out of the way of tramp metal. The high density material being pumped is pumped through the outlet B in direction F to the next station, such as from oxygen reactor 38 to diffuser washer 40. Operation of the pump 10 may be continued until the blades 16 experience normal wear, at which time the mounts 36 can be removed and new blades 16 substituted.

It will thus be seen that according to the present invention a pump has been provided which simply and inexpensively solves the long standing problem of pump destruction due to tramp metal in the high consistency material being pumped, and for the first time makes it practical to place a thick stock pump in a digester discharge line. While the invention has been herein shown and described in what is presently conceived to be the most practical and preferred embodiments thereof, it will be apparent to those of ordinary skill in the art that many modifications may be made therein within the scope of the invention, which scope is to be accorded the broadest interpretation of the appended claims so as to encumber all equivalent structures, methods, and combinations.

What is claimed is:

1. A pump for pumping high consistency material, comprising:

means for defining a closed pumping chamber, said chamber having an inlet and an outlet;

a pair of rotors in the pumping chamber;

means for transforming rotation of said rotors into linear pumping of high consistency material so that a head of about 10–170 ft. can be achieved during pumping of high consistency material and so that damage will not occur to the pump when tramp metal or the like is contained within the high consistency material pumped, said means comprising a plurality of blades associated with each rotor and extending radially therefrom which remain rigid during pumping of high consistency material but flex only so as to prevent damage to any pump components when tramp metal or the like is encountered thereby;

each said blade comprising a tip portion of relatively rigid material and a base portion of relatively rigid material, and an intermediate portion connecting said tip and base portions, said intermediate portion being flexible so that said blade flexes only at said intermediate portion when tramp metal or the like is encountered thereby;

means for rotating said rotors in opposite angular directions, said means including a shaft associated with each rotor; and means for mounting said rotor shafts so that each blade from one rotor sequentially cooperates with but does not substantially engage a circumferential surface of the other rotor intermediate two blades of the other rotor, during continued rotation of said rotors, and so that each blade sequentially cooperates with but does not substantially engage an interior portion of said means defining a closed pumping chamber during continued rotation of said rotors.

* * * * *